US006558237B1

(12) United States Patent
Loth et al.

(10) Patent No.: US 6,558,237 B1
(45) Date of Patent: May 6, 2003

(54) KNIFE RING MACHINING TOOL FOR MACHINING CHIPS

(75) Inventors: Robert Loth, Lage-Müssen (DE); Rolf Ameling, Bielefeld (DE)

(73) Assignee: B. Maier Zerkleinerungstechnik GmbH, Bielefeld (DE)

( * ) Notice: Subject to any disclaimer, the term of this patent is extended or adjusted under 35 U.S.C. 154(b) by 0 days.

(21) Appl. No.: 09/667,144

(22) Filed: Sep. 21, 2000

(51) Int. Cl.[7] ..... B24B 7/00

(52) U.S. Cl. ..... 451/122; 451/69; 241/85; 241/86.2; 241/191; 241/278.2

(58) Field of Search ..... 451/45, 122, 128, 451/194, 178, 195, 232, 65, 69, 541; 241/85, 86.2, 88.1, 185.5, 191, 278.2, 280

(56) References Cited

U.S. PATENT DOCUMENTS

| | | | | | |
|---|---|---|---|---|---|
| 1,424,225 | A | | 8/1922 | Williams | |
| 4,796,818 | A | * | 1/1989 | Thoma | 241/85 |
| 4,972,888 | A | * | 11/1990 | Dean | 144/172 |
| 5,209,025 | A | * | 5/1993 | Martin et al. | |
| 5,390,862 | A | * | 2/1995 | Eglin | 241/29 |
| 5,525,094 | A | * | 6/1996 | Pallmann | 451/45 |
| 5,823,856 | A | * | 10/1998 | Pallmann | 451/45 |
| 5,868,602 | A | * | 2/1999 | Pallmann | 451/10 |
| 6,036,588 | A | * | 3/2000 | Loth | 451/293 |
| 6,299,082 | B1 | * | 10/2001 | Smith | 241/186.35 |
| 6,435,433 | B1 | * | 8/2002 | Hesch | 241/186.35 |

FOREIGN PATENT DOCUMENTS

| | | | |
|---|---|---|---|
| DE | 26 16 849 | 11/1977 | B27L/11/02 |

* cited by examiner

*Primary Examiner*—Eileen P. Morgan
(74) *Attorney, Agent, or Firm*—Randall J. Knuth

(57) ABSTRACT

A knife ring machining tool for machining chips, with a knife ring comprising a crown of knife packets as well as two carrier rings carrying the packets, which rings are arranged on the ends of the knife packets. Each knife packet includes a knife that is inclined against the radial direction and whose cutting edge faces inward, with a rotor arranged coaxially with the knife ring and surrounded by the latter. The rotor includes a plurality of rotor blades that carry strip-shaped cleaving knives on the outer ends, which knives for their part run parallel to the rotor axis and extend over the width of the rotor. Each cleaving knife is fastened by screws to the associated rotor blade, while each screw connection comprises a wedge element that tapers outward in radial direction in a wedge shape, as viewed in a section vertical to the rotor axis.

8 Claims, 3 Drawing Sheets

KNIFE RING MACHINING TOOL FOR MACHINING CHIPS

BACKGROUND OF THE INVENTION

1. Field of the Invention

The invention is relative to a knife ring machining tool for machining or cutting chips and shavings. Such a machining tool is known, e.g., from DE 32 47 629 C1.

2. Description of the Related Art

Such a machining tool is designed as follows: It comprises a knife ring with a plurality of knife packets. Each knife packet comprises a knife that faces inward with its cutting edge and is inclined against the radial direction. The knife ring surrounds a rotor arranged coaxially with the knife ring. The rotor comprises a plurality of rotor blades. Each rotor blade carries a strip-shaped cleaving knife arranged parallel to the shaft and extending over the width of the rotor. Chips are supplied to the rotor, substantially in the axial direction, which the rotor casts outwardly against the knife packet. These cleaving knives cooperate thereby with the knives of the knife ring in that they break the chips down into fine shavings.

The radially outside dimension of the cleaving knives, the so-called flight circle, is a very critical dimension. It must be precisely adjusted and also maintained in this adjustment. It must be prevented, in any case, that the cleaving knives extend too far outward radially since they otherwise collide with the knives of the knife ring.

The cleaving knives are fastened to the rotor blades by screws. The cleaving knives comprise oblong holes extending in radial direction and through which the screws are run. These oblong holes are necessary because the cleaving knives wear down in the course of time and because a certain radial adjustment toward the outside is accordingly necessary after a certain operating time. The connection with the fastening screws can therefore only be a non-positive one. However, this is critical because a slow radially outward travel or creep of the cleaving knives can occur due to the high centrifugal forces.

The invention has the problem of designing a knife ring machining tool, especially its rotor, in such a manner that the radial position of the cleaving knives is reliably maintained.

SUMMARY OF THE INVENTION

The inventors have found a solution that is as simple as it is reliable. Each screw connection is provided, in accordance with the invention, with a wedge-shaped element through which the fastening screw is run and that tapers, viewed in a section vertical to the axis, in radial direction from the outside to the inside in a wedge shape.

This has the following effect: Centrifugal forces occur during operation, as stated. These forces act on the cleaving knives but also on the wedge elements. Both of them have a tendency to travel outward; however, an even more forceful tightening of the screw connection occurs even at a minimal radially outward travel on account of the wedge effect of the wedge element. This prevents the individual cleaving knife from executing an appreciable radially outward traveling motion.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
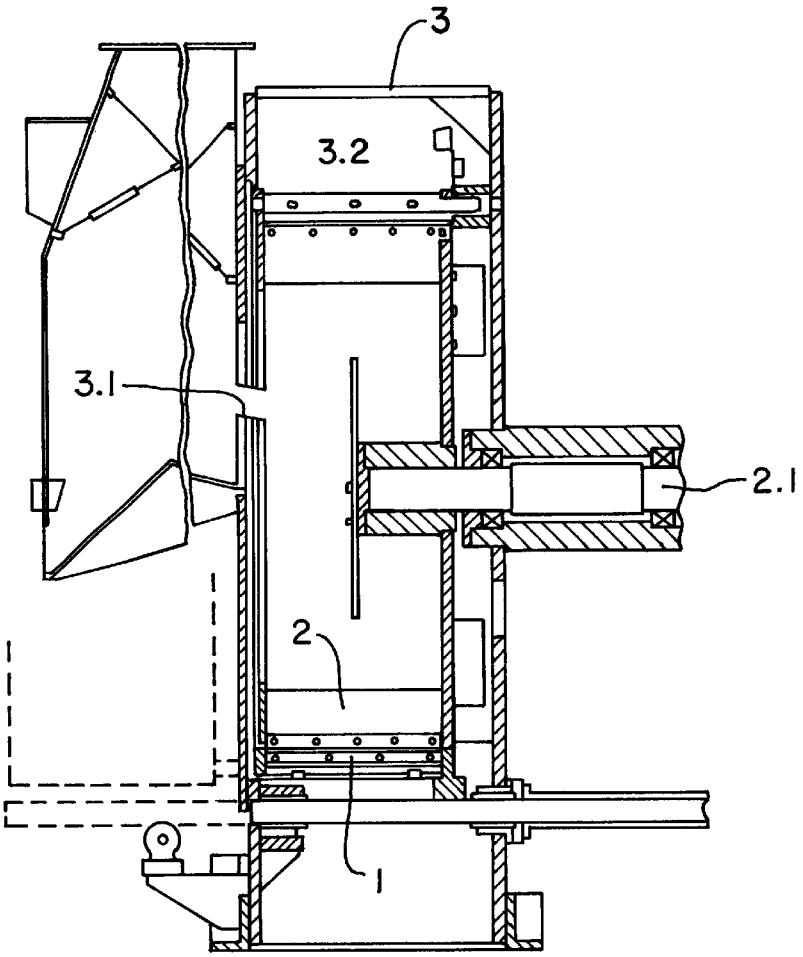
FIG. 1 shows a cross section through a knife ring machining tool.

The knife ring machining tool shown in FIG. 1 comprises stationary knife ring 1. The knife ring surrounds rotor 2 resting on rotor shaft 2.1. Knife ring 1 and rotor 2 are arranged coaxially to one another. Knife ring 1 is permanently built into housing 3. Housing 3 comprises inlet 3.1 for supplying chips and also comprises chip exit conduit 3.2 surrounding the knife ring.

Figure 2:
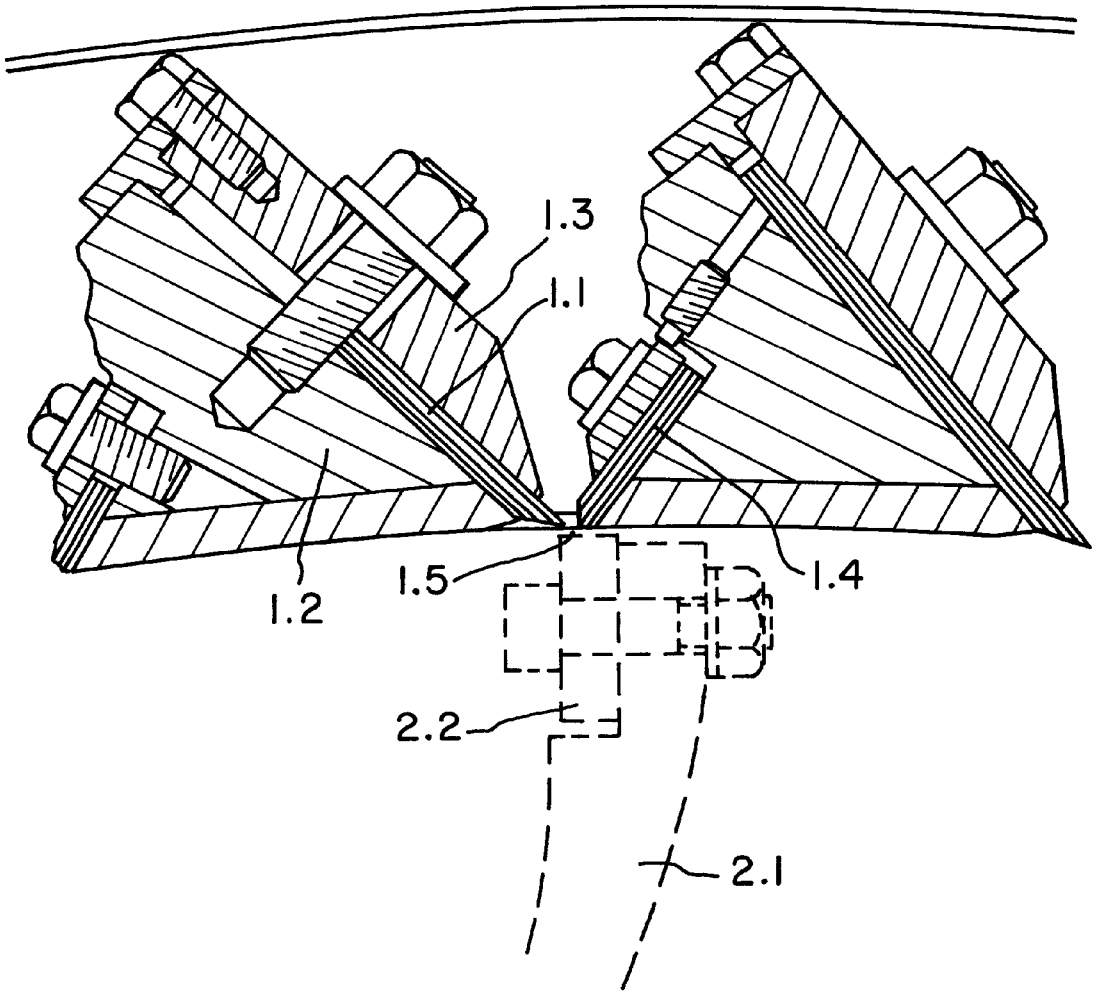
FIG. 2 shows a section of the knife ring in a view in axial direction and greatly enlarged in comparison to FIG. 1.
Figure 3C:
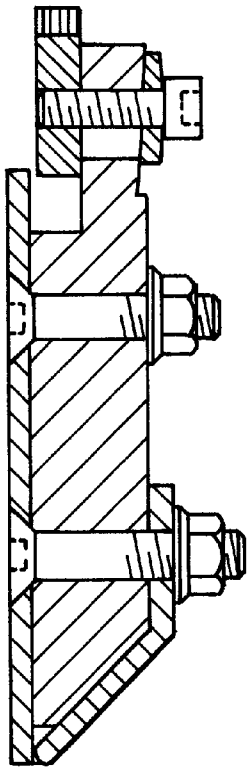
FIGS. 3*a*, 3*b*, and 3*c* show a rotor blade with different positions of the associated cleaving knife.
Figure 3B:
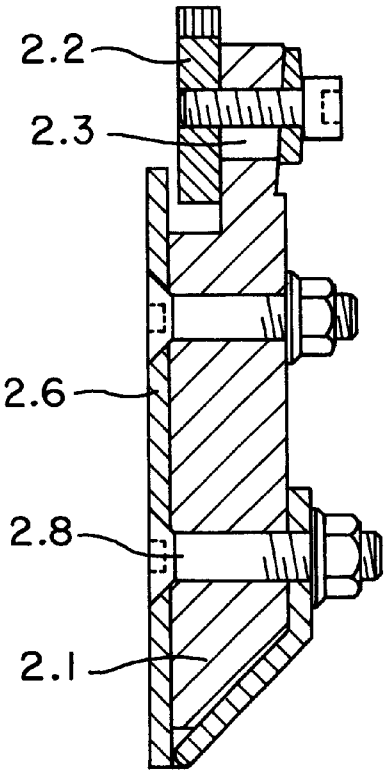
Figure 3A:
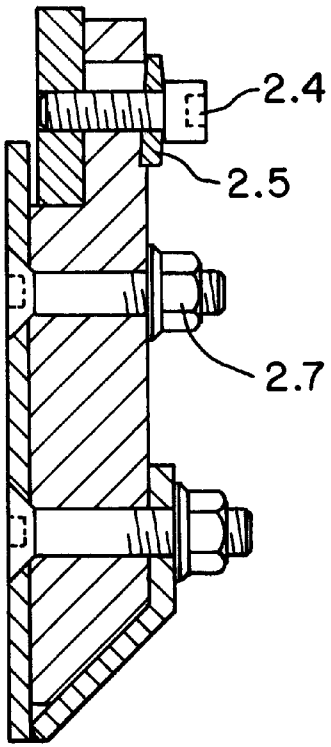

FIG. 2 shows three knife packets as a component of knife ring 1. Each knife packet comprises a knife 1.1. This knife is clamped in between knife carrier 1.2 and clamping plate 1.3. Each knife packet is provided in the present instance with a so-called stock knife 1.4. The two knives, namely, knife 1.1 and knife 1.4 form slot 1.5 with one another for the radially outward passage of the chips. The invention can also be used in the case of knife packets without a stock knife. It this dimension is exceeded, a collision occurs between cleaving knife 2.2 and knife 1.1 of knife ring 1.

Figure 4:
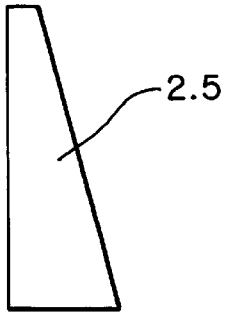
FIG. 4 shows a wedge element enlarged in comparison to the views of FIGS. 3*a*, 3*b*, and 3*c*.

FIGS. 3 and 4*a*, 4*b* and 4*c* show the rotor and the cleaving knife more precisely. FIGS. 4*a*, 4*b* and 4*c* are especially revealing. They illustrate different radial positions of cleaving knife 2.2.

FIGS. 4*a*, 4*b*, and 4*c* show the following in detail: Each rotor blade 2.1 comprises oblong hole 2.3. Furthermore, screw 2.4 is provided. This screw is run through the oblong hole and is screwed into a corresponding threaded bore in cleaving knife 2.2. Wedge strip 2.5 is a critical component. This strip is placed between the head of screw 2.4 and the rotor blade. The shape of wedge strip 2.5 can be seen in FIG. 5. It is wedge-shaped in the sense that it tapers radially from the inside toward the outside. If cleaving knife 2.2 and wedge strip 2.4 have a tendency to travel outward during operation due to centrifugal force, the screw connection is tightened even more automatically due to the wedge shape of wedge element 2.5, which brings about an immediate standstill of the radial traveling movement of the cleaving knife from the inside toward the outside.

It can also be seen that the rotor blade is surrounded in the outer range shown by metallic wear sheet 2.6. This sheet is screwed to rotor blade 2.1 by screws 2.7, 2.8 with associated nuts.

While this invention has been described as having a preferred design, the present invention can be further modified within the spirit.and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A knife ring machining tool for machining chips, said tool comprising:

a knife ring having a ring of knife packets, each knife packet includes a knife;

a rotor with an axis arranged coaxially with and surrounded by said knife ring;

said rotor includes a plurality of rotor blades having outer ends wherein each of said rotor blades carry strip-shaped cleaving knives on the outer ends of said plurality of rotor blades, said cleaving knives run parallel to said rotor axis;

each said cleaving knife is fastened by screws to one of said rotor blades thereby making a screw connection; and each screw connection includes a wedge shaped element that tapers radially outward from said rotor axis.

2. The knife ring machining tool according to claim 1, in that several screw connections are provided per each of said cleaving knives and that a single strip per each of said cleaving knives is provided as a wedge shaped element which strip tapers radially outward from said rotor axis.

3. The knife ring machining tool according to claim 1, in which each cleaving knife includes holes for receiving said screws through the holes.

4. The knife ring machining tool according to claim 1, in which the blades are connected to a metallic wear sheet using a screw.

5. The knife ring machining tool according to claim 2, in which each cleaving knife includes holes for receiving said screws through the holes.

6. The knife ring machining tool according to claim 2, in which the blades are connected to a metallic wear sheet using a screw.

7. The knife ring machining tool according to claim 3, in which the blades are connected to a metallic wear sheet using a screw.

8. The knife ring machining tool according to claim 5, in which the blades are connected to a metallic wear sheet using a screw.

* * * * *